United States Patent [19]

Niederholtmeyer

[11] Patent Number: 4,460,328

[45] Date of Patent: Jul. 17, 1984

[54] PROCESS AND APPARATUS FOR UTILIZING WASTE OIL

[76] Inventor: Werner J. Niederholtmeyer, 7804 Fritz Rd., Fort Wayne, Ind. 46802

[21] Appl. No.: 513,017

[22] Filed: Jul. 12, 1983

Related U.S. Application Data

[62] Division of Ser. No. 220,827, Dec. 29, 1980, Pat. No. 4,392,820.

[51] Int. Cl.[3] ..... F23D 11/44; F23G 7/64

[52] U.S. Cl. ..... 431/11; 431/12; 431/3; 431/28; 431/41; 431/77; 431/208; 431/281; 110/238

[58] Field of Search ..... 431/11, 12, 3, 28, 41, 431/37, 75, 77, 86, 89, 208, 162, 161, 215, 281; 110/238

[56] References Cited

U.S. PATENT DOCUMENTS

| | | | |
|---|---|---|---|
| 2,235,664 | 3/1941 | Bachmann | 431/208 X |
| 3,611,954 | 10/1971 | Monroe | 110/238 |
| 3,692,459 | 9/1972 | Erb | 431/11 |
| 3,838,651 | 10/1974 | Dingwell | 110/238 |
| 4,025,282 | 5/1977 | Reed et al. | 431/281 X |

*Primary Examiner*—Randall L. Green

*Attorney, Agent, or Firm*—Larry J. Palguta; John A. Young

[57] ABSTRACT

A heating system comprising the combination of storage vessels (10, 12) for conventional heating oil and waste oil, respectively, and in which the two storage vessels (10, 12) are effectively sealed apart, one from the other. At the initial stage of heating, conventional heating oil generates temperature of a predetermined amount and the waste oil from vessel (12) is thereafter utilized after having been heated either from a feedback of heat (26, 28) developed by the conventional heating oil from vessel (10) or by a separate electrical resistor element (133), such heating making the waste oil effective as a heating medium. The flows from the two storage vessels (10, 12) containing the waste oil and conventional oil, are pressure controlled (64, 84) so that relief pressure feedback (70, 82) is provided in each distribution network (14, 30). The two distribution networks (14, 30) are effectively communicated to a heater box in a boiler (22) and controlled by valving means (60) which permits flow from only one of the oil storage sources, and effectively precludes any commingling of oil from the sources either at the burner nozzle (142) or in the storage vessels (10, 12).

6 Claims, 2 Drawing Figures

PROCESS AND APPARATUS FOR UTILIZING WASTE OIL

This is a division of application Ser. No. 220,827 filed Dec. 29, 1980, now U.S. Pat. No. 4,392,820, issued July 12, 1983.

DESCRIPTION

1. Technical Field

A boiler or other heating mechanism contains a nozzle which initially receives clean conventional oil and after the boiler attains a certain temperature it is thereafter heated by injection of waste oil through the nozzle.

2. Background Art

While it is well known that waste oil has a high caloric content, it has not been an effective heating medium because it tends to clog conventional nozzles. It proved undesireable because it produces dense black smoke which is objectionable for environmental purposes and has a fixed reputation for clogging the interior of burner boxes, fouling the works and preventing effective operation thereafter. Although numerous attempts have been made to utilize a combination of conventional oil and waste oil, such efforts have thus far been unsuccessful except in very limited applications.

SUMMARY OF THE INVENTION

It is an object of the present invention to make waste oil utilizable in combustible form, by first using a source of conventional heating oil to heat up a boiler or other heating chamber by injecting the conventional oil through a nozzle; once an effective temperature is reached, a portion of that heat is recycled to a recuperator to heat incoming waste oil thereafter utilized as the primary heating medium. By first preheating the waste oil to its flash temperature, the usual troubles associated with waste oil are obviated. That is, the heating is clean, i.e., there is no accompaniment of dense, black smoke, there is minimal ash, the burning is efficient and complete, there is no fouling of the nozzle, and the viscosity of the preheated waste oil is adjusted to an acceptable level.

Another object of the present invention is to obtain a predetermined heating period through a timer means, which utilizes two oil feeder networks, one network from a conventional oil storage and another network from a waste oil storage, with the two networks effectively isolated one from the other, so that there is no commingling of oil in the network or in the respective storage means. Each network is equipped with pressure responsive return means so that as a safety measure, oil can be recycled within the respective networks precluding the occurrence of excessive and dangerously high pressures.

It is an object of the present invention to use at the beginning of each heating cycle, conventional oil which will clean the nozzle, and maintain it clean.

The heating chamber is controlled by a thermostat, and is effective for starting and stopping the operation, the initial phase or start-up phase is always with oil from the conventional oil storage means so that the nozzle will be clean and accommodating to the heated waste oil.

At the end of the heating operation, as well as at the beginning, of each heating oil operation, there is a brief period of conventional heating oil usage so that the nozzles are cleaned at the beginning and end of each heating cycle.

An important feature of the present invention lies in the means for heating up the waste oil to render it combustible, such means being in the form of a recuperator which receives feedback heat in the boiler, and can also include an electrical resistor element which is effective for preheating the waste oil.

BEST MODE FOR CARRYING OUT THE INVENTION, IN DETAILED DESCRIPTION

Figure 1:
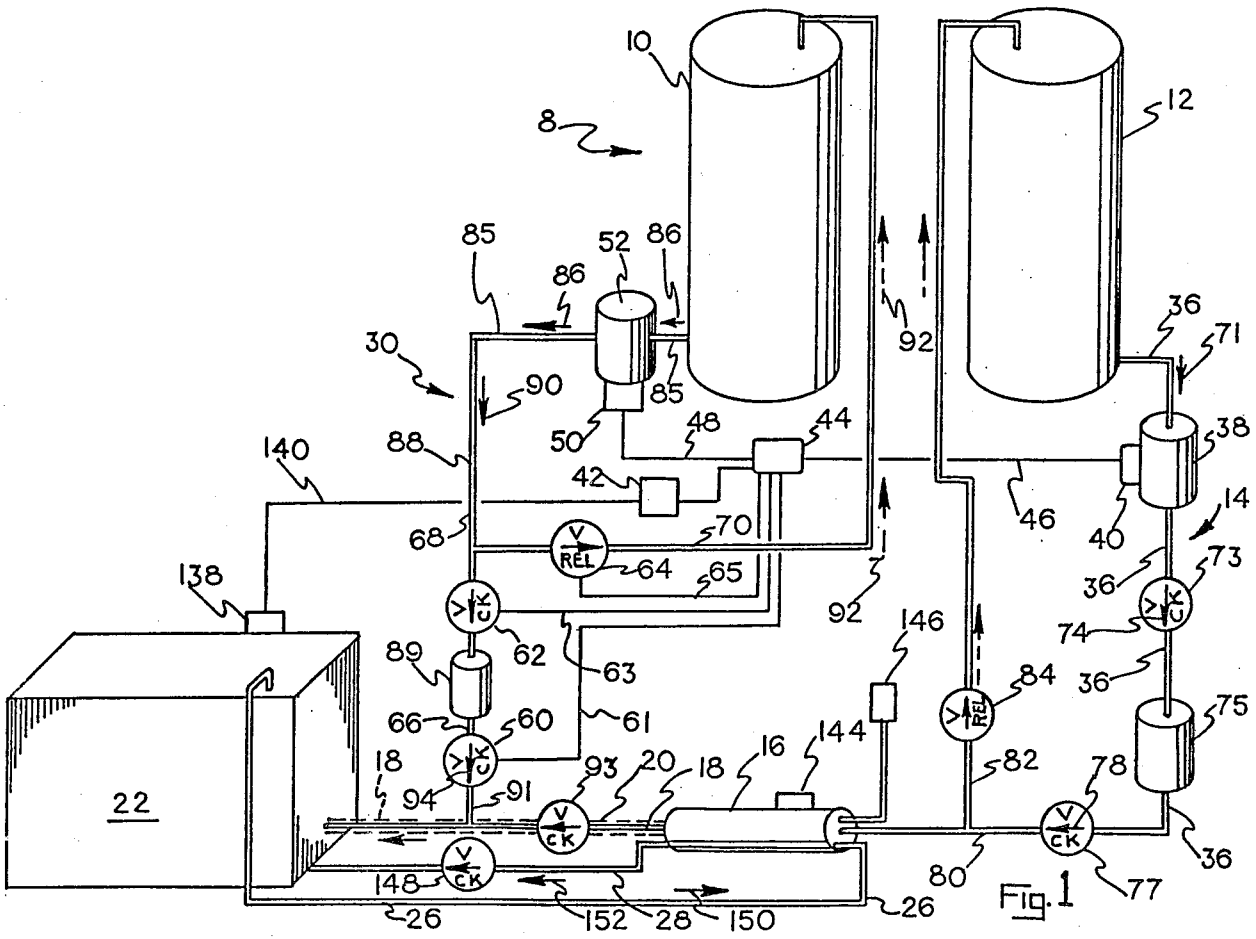
FIG. 1 is a schematic view illustrating in isometric view, the storage vessels, control elements, recuperator and boiler; and, FIG. 2 is a line drawing somewhat similar to FIG. 1, but illustrating a second embodiment of the invention in which the recuperator or heating means for the waste oil is effected by electrical resistor means, otherwise the embodiment is essentially the same, but appearing as a line drawing and with the filter elements, and wet-base boiler illustrated in cross-sectional view.

Referring first to the embodiment illustrated in FIG. 1, there is shown a heating system 8 including two storage vessels 10 and 12, storage vessel 10 receiving conventional heating oil, and storage vessel 12 receiving waste heating oil.

There is a distribution network designated generally by reference numeral 14 for conveying the waste oil from vessel 12 through a recuperator 16 and thence through a conduit line 18 jacketed by insulation 20 to a wet-box boiler 22. Heat from the boiler is recycled through a feedback line 26 to recuperator 16 having a return line 28 to the boiler.

Initially, the wet-base boiler 22 is supplied conventional heating oil by a supply network designated generally by reference numeral 30. It should be understood that reference to a wet-base boiler is illustrative of only one of the means for converting heat from a burner box to a heating medium, and it being further understood that instead of a wet-base boiler, a combination plenum hot-air system or conventional steam system can be utilized equally with the present invention.

Control System

Each of the distribution networks 14, 30 includes a feedback line to prevent excessive pressures (in excess of 120 psi) within the line which could otherwise be destructive to the network. Referring to the network 14 used for the waste oil, the network includes line 36, a pump 38 and motor 40 controlled by a timer 42 which operates a solenoid 44 adapted to act through circuit 46 to the motor 40 associated with pump 38. The timer 42 and solenoid 44 also control motor 50 through circuit 48. The motor 50 associated with pump 52 provides oil supply from storage vessel 10. The solenoid 44 operated by the timer 42, operates the motors 40 and 50 so that the motor 40 remains running when the motor 50 is operating.

The solenoid 44 additionally controls three check valves 60, 62, 64 in network 30, check valve 60 being in conduit section 66, check valve 62 being in conduit section 68 and check valve 64 being in conduit section 70 which forms a return for oil to the vessel 10. The solenoid controls these valves 60, 62, 64 through circuit connections 61, 63 and 65 respectively.

Thus, when the pump 38 is operated, the solenoid 44 provides the check valve positioning which closes valves 60 and 62. Motor 50 remains on. Motor 40 is operated, pump 38 pumps waste oil from network 14 to the boiler 22 in the direction of the arrow 71, check valve 73 permits fluid movement in the direction of the arrow 74 through filter 75 and pressure responsive check valve 77 is positioned so that it will permit movement of fluid in the direction of arrow 78 in line 80. Insuring against destructive impairment of any of the device because of excessive build up of pressure within the network 14 leading to the recuperator 16 is a bypass return line 82 having relief valve 84. When pressure is below a predetermined value viz., about 120 psi., pressure responsive relief valve 84 prevents return of fluid through return line 82 and the open check valves 73 and 77 permit movement of fluid by the pump 38, operated by the motor 40 from vessel 12 through lines 36, 80, to the recuperator 16, conduit section 18, to the boiler 22. At the same time, closed check valve 60 associated with the network 30 prevents waste oil fluid in network 14 to enter network 30 toward the vessel 10. Check valve 60 permits movement only in the direction of the arrow 94, thus effectively separating any communication between vessels 10, 12. All of the waste oil from vessel 12 passes through filter 75. The filter can be replaced from time to time and the system does not have to be re-bled because the check valve 73 prevents reverse drainage of fluid.

Referring now to the supply network 30 from vessel 10, the pump 52 operated by motor 50 from solenoid 44 and timer 42 causes oil to pass through the conduit section 85 in the direction of the arrow 86 and then through conduit section 88 in the direction of the arrow 90, past now opened check valve 62, filter 89, and now opened solenoid-operated one way valve 60 through conduit line section 91 to conduit section 18. In the event that excessive pressure is developed (above 120 psi) the solenoid operated pressure relief valve 64 is operated in by-pass return section 70 which permits fluid to move in the direction of the arrow 92 past relief valve 64, thereby relieving excess pressure in the supply conduit network 30. The supply of oil to the boiler 22 from network 30 is precluded from entering network 14 by the check valve 93 in insulated conduit section 18.

At all times, the supply of oil from vessel 10 in network 30 is in the direction of the arrows 86, 90 permitting fluid to flow in a direction toward the boiler but without entering the network 14.

Figure 2:
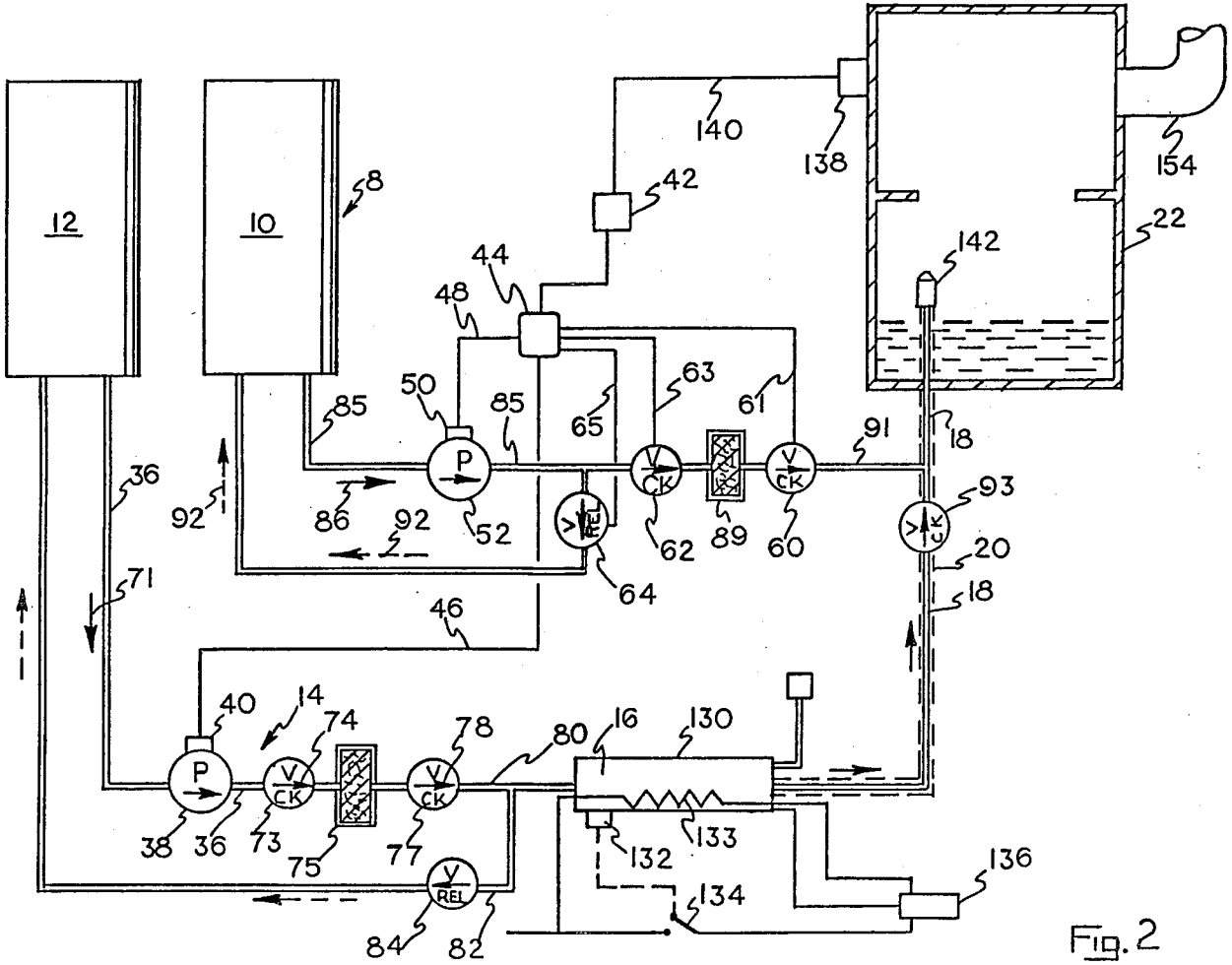

Further Embodiment (FIG. 2)

In the further embodiment, FIG. 2, in lieu of a recuperator chamber which receives heat from the fire box, there is an electrical heater 130 which includes resistor element 133 disposed within recuperator 16 and which heats the waste oil to the appropriate temperature before its injection through the heater nozzle into the boiler.

There is a temperature sensor 132 which continuously monitors the temperature of the waste oil and the temperature sensor controls the electrical switch 134 leading to power source 136.

Thus, the waste oil is maintained at a certain temperature by electrical resistance element 133; the temperature of the waste oil is maintained at a temperature between 180° F. to 230° F. In all other respects, the operation is the same as in the embodiment of FIG. 1.

Operation

In operation, when the boiler thermostat 138 within the boiler 22 signals a need for heat, the timer 42 is operated through line 140, and in turn energizes the solenoid 44 having electrical connections with motors 40 and 50, valve 60, valve 62, and valve 64. The motor 50 is energized, operating pump 52, and conventional oil is supplied immediately through conduit lines 85, 88 past check valves 60, 62 in the direction of the arrows 86, 90 past one-way solenoid operated valves 60, 62 and through conduit section 18 to the nozzle 142 (FIG. 2) in the wet-base boiler 22. None of the oil from vessel 10 is permitted by the distribution network 30 to mingle with the vessel 12 or the network 14 because one way check valve 93 prevents movement past the check valve 93 into the network 14.

After approximately 15 to 60 seconds at which time the boiler reaches a temperature of 180°–230° F., the timer 42 causes the solenoid 44 to be operated on motor 40, closing solenoid operated one way valve 60 and closing check valve 62.

During operation of the pump 52, the bypass or return line 70 will permit recycling of the conventional oil.

After the alotted time of operation by conventional oil from vessel 10, some of the boiler heat is recycled through line 26 to the recuperator 16 (see FIG. 1). A return line 28 connects to the boiler 22. A temperature sensor 144 regulates the flow of heat from the boiler and a bleeder 146 purges air from the recuperator. A check valve 148 in return line 28 ensures flow in the correct directions indicated by arrows 150, 152.

The temperature within the recuperator 16 is sufficient to heat the waste oil from the vessel 12 to approximately 180°–230° F. at which time its viscosity is adjusted and its flash point adjusted so that it will be satisfactory as a fuel therafter in the boiler.

When the pump 38 is caused to operate by the motor 40, waste oil is drawn through line 36 in the direction of the arrow 71 through the pump 38, conduit section 36, past the check valve 73 in the direction of the arrow 74 and filter 75 through line 36 and past one way check valve 77 and into the recuperator 16 where it is preheated and then passes through conduit section 18 which is insulated by an insulation layer 20. The preheated waste oil is injected through the nozzle 142 (not shown in FIG. 1) in the boiler 22 and is burned, heating the water which becomes the heat distribution medium.

When the waste oil is burned, the gasses which emanate from the flue 154 (FIG. 2) are virtually colorless and odorless.

The hot box or fire box also contains an ash collector (not shown) but there is little or no ash other than extremely white residue and this residue is negligble.

At the base of the boiler 22 is water, making it known as a wet-base boiler which is a satisfactory form of boiler usable with the present invention.

None of the waste oil from vessel 12 and distribution network 14 enters vessel 10 containing the conventional oil because the solenoid operated valve 60 which is at the entrance of the network 30 is closed by the solenoid 44, through circuit line 61. The motor 40 is only operated when the solenoid valve 60 is closed, and vice versa, solenoid operated valve 60 is open only when the motor 40 associated with the waste oil pump 38 is nonoperative. Consequently, there can never be intermixing or commingling of fuel between vessels 10 and 12 and the flows from vessels 10 and 12 are always separated so that there is supplied oil to the boiler from only one or the other of vessels 10, 12 respectively.

The waste oil makes up the predominate amount of fuel. The function of the conventional oil is only to serve as a "start-up/close-up" fuel in which the boiler is initially heated and after having been heated to a preferred amount, generates sufficient heat to the recuperator insuring a proper preliminary heating of the waste oil. Once this is accomplished, the nozzle is "cleaned" by the initial inflow of conventional oil, the system is prepared and adapted for waste heating oil to be burned and with minimum residue and minimum pollutants in the flue gasses which, as previously mentioned, are virtually colorless and odorless.

Once the boiler has reached the necessary temperature, a thermostatic control 138 discontinues the described operation at which time the timer 42 is again initiated, and once again operates the solenoid 44 terminating inflow from the waste heat boiler; there is a final interval of burning from the conventional oil vessel 10 so that the nozzle is flushed of any residue of the waste oil at the termination of each shut-off of the boiler.

Thus, at the initiation and at the termination of the boiler heating, there is a brief interval of heating from the supply of conventional heating oil, but for the main period of boiler heating, there is utilized waste oil from vessel 12 only.

The present invention represents the first time in which waste oil can be effectively utilized for conventional heating, it having been found that the described operation can be effectively carried out for home heating for small businesses and the like, and there is virtually no limitation on the size of the boiler design, the user's preference being the sole criteria of boiler size.

Industrial Applicability

The invention is used for home heating and commercial heating systems in which the principal heating medium is waste oil derived from such sources as crank cases of automobiles and other vehicles, such oil being of little commercial value previously but now upgraded to a primary fuel source.

Conclusion

While the present invention has been illustrated and described in connection with selected example embodiments, it will be understood that these are illustrative of the invention and are by means restrictive thereof. It is reasonably to be expected that those skilled in this art can make numerous revisions and adaptations of the invention and it is intended that such revisions and adaptations will be included within the scope of the following claims as equivalents of the invention.

I claim:

1. A process for utilizing separately within an automatically controlled heating mechanism both conventional heating oil fuel and waste oil fuel, the fuels contained in separate storage means and provided to the heating mechanism by automatic control means, operating valve means, respective supply lines, and means for pumping, comprising the steps of: continuously sensing temperature by means of thermostat means operatively connected to the control means; sensing a predetermined temperature and initiating a heating cycle by the control means actuating, in response to the thermostat means, respective pumping means to supply for a predetermined period of time conventional heating oil fuel for combustion at burner means disposed in said heating mechanism, in order to attain a heating mechanism temperature of a predetermined value; automatically closing the operating valve means after said predetermined period of time and commencing operation of respective pumping means to supply waste oil fuel to the heating mechanism for combustion therein, the supply of waste oil fuel being provided to the heating mechanism without comingling with the conventional heating oil fuel; preheating the waste oil fuel to a control flash temperature prior to combustion at said burner means in order to enhance its combustibility; continuously monitoring the temperature within said heating mechanism and controlling the inflow of fuel in accordance therewith; sensing a heating temperature and in response automatically terminating the supply of waste oil fuel and opening the operating valve means wherein the control means deactuates the pumping means for waste oil fuel and the open operating valve means permits conventional heating oil fuel to be supplied to the burner means for combustion; and cleaning the burner means by burning conventional heating oil fuel for a predetermined time, whereby the fuels supplied to the heating mechanism during the heating cycle are effectively prevented from being comingled.

2. The process in accordance with claim 1, further comprising the step of sensing supply line pressure to effect valve operation and the recycling of fuel to respective storage means.

3. The process in accordance with claim 1, wherein the step of preheating the waste oil fuel includes electrical heating means in order to provide a flow of preheated waste oil fuel from said electrical heating means to the heating mechanism whereby the waste oil fuel is at an elevated temperature at the time of burning.

4. The process in accordance with claim 1, including the step of filtering at least the waste oil fuel prior to combustion in said heating mechanism.

5. The process in accordance with claim 1, further comprising the step of sensing the temperature of heat generated by the initial burning of conventional heating oil fuel, the heat being supplied to heat exchanger means for preheating the waste oil fuel.

6. The process in accordance with claim 1, wherein the step of preheating said waste oil fuel includes utilizing heat generated from burning the conventional heating oil fuel.

* * * * *